US007407689B2

(12) United States Patent
Joshi et al.

(10) Patent No.: US 7,407,689 B2
(45) Date of Patent: Aug. 5, 2008

(54) AQUEOUS ACIDIC IMMERSION PLATING SOLUTIONS AND METHODS FOR PLATING ON ALUMINUM AND ALUMINUM ALLOYS

(75) Inventors: Nayan H. Joshi, Rock Hill, SC (US); Maulik D. Mehta, Charlotte, NC (US)

(73) Assignee: Atotech Deutschland GmbH, Berlin (DE)

( * ) Notice: Subject to any disclaimer, the term of this patent is extended or adjusted under 35 U.S.C. 154(b) by 0 days.

(21) Appl. No.: 10/606,460

(22) Filed: Jun. 26, 2003

(65) Prior Publication Data

US 2005/0008788 A1 Jan. 13, 2005

(51) Int. Cl.

| | |
|---|---|
| ***B05D 1/18*** | (2006.01) |
| ***B05D 3/10*** | (2006.01) |
| ***C23C 18/16*** | (2006.01) |
| ***C25D 5/44*** | (2006.01) |

(52) U.S. Cl. ..... 427/309; 427/328; 427/406; 427/436; 427/437; 427/438; 205/80; 205/183; 205/188; 205/213; 205/85; 205/177

(58) Field of Classification Search ..... 427/429, 427/435, 436, 437, 438, 443.1, 457, 601
See application file for complete search history.

(56) References Cited

U.S. PATENT DOCUMENTS

| | | | | | |
|---|---|---|---|---|---|
| 2,580,773 | A | * | 1/1952 | Heiman | 427/328 |
| 2,676,916 | A | * | 4/1954 | Zelley | 205/184 |
| 2,892,760 | A | * | 6/1959 | Gundel et al. | 205/240 |
| 3,669,854 | A | * | 6/1972 | Harbulak | 205/314 |
| 3,672,964 | A | | 6/1972 | Bellis | 204/33 |
| 3,928,147 | A | * | 12/1975 | Kowalski | 205/205 |
| 3,930,081 | A | * | 12/1975 | Shinomiya et al. | 205/85 |
| 3,960,677 | A | * | 6/1976 | Hildering et al. | 205/313 |
| 4,134,802 | A | * | 1/1979 | Herr | 205/260 |
| 4,356,067 | A | * | 10/1982 | McCoy | 205/239 |
| 4,416,737 | A | * | 11/1983 | Austin et al. | 205/99 |
| 4,488,942 | A | * | 12/1984 | Martin et al. | 205/245 |
| 4,670,312 | A | | 6/1987 | Ehrsam | 427/438 |
| 4,686,017 | A | * | 8/1987 | Young | 205/234 |
| 4,755,265 | A | | 7/1988 | Young | 204/45.1 |
| 4,888,218 | A | | 12/1989 | Suzuki et al. | 427/383.9 |
| 5,182,006 | A | | 1/1993 | Haydu et al. | 205/213 |
| 5,234,574 | A | * | 8/1993 | Tsuji et al. | 205/213 |
| 5,405,523 | A | * | 4/1995 | Eckles | 205/245 |
| 5,718,745 | A | | 2/1998 | Itoh et al. | 106/1.22 |
| 5,965,279 | A | | 10/1999 | Yu | 428/646 |
| 6,162,343 | A | * | 12/2000 | Takami et al. | 205/119 |
| 6,790,265 | B2 | * | 9/2004 | Joshi et al. | 106/1.17 |
| 6,811,819 | B2 | * | 11/2004 | Joshi et al. | 427/307 |

FOREIGN PATENT DOCUMENTS

| | | | |
|---|---|---|---|
| FR | 2 475 582 | | 8/1981 |
| GB | 1 133 679 | | 11/1968 |
| GB | 1 263 351 | | 2/1972 |
| GB | 1 445 553 | | 8/1976 |
| GB | 1 464 048 | | 2/1977 |
| JP | 2000-256864 | * | 9/2000 |
| WO | 02/36853 A1 | | 5/2002 |

OTHER PUBLICATIONS

"The Surface Treatment and Finishing of Aluminum and Its Alloys" by S. Wernick, R. Pinner and P.G. Sheasby, 5th Edition, vol. 2; pp. 1041-1043 and 1052-1053.

PCT/US2004/011417; PCT International Search Report mailed Jan. 11, 2005.

Database WPI Section Ch, Week 197432, Derwent Publications Ltd., London, GB; AN 1974-58137V, XP002308445 & SU 398 704 A; Apr. 4, 1974.

* cited by examiner

*Primary Examiner*—Katherine A Bareford
(74) *Attorney, Agent, or Firm*—Renner, Otto, Boisselle & Sklar, LLP

(57) ABSTRACT

The present invention provides a non-cyanide aqueous acidic immersion plating solution having a pH of from about 3.5 to about 6.5 and comprising zinc ions, nickel ions and/or cobalt iron ions, and fluoride ions. In one embodiment the immersion plating solutions of the invention also contain at least one inhibitor containing one or more nitrogen atoms, sulfur atoms, or both nitrogen and sulfur atoms. The present invention also relates to methods for depositing zinc alloy protective coatings on aluminum and aluminum alloy substrates comprising immersing the aluminum or aluminum alloy substrate in the non-cyanide acidic immersion plating solutions of the invention. Optionally, the zinc alloy coated aluminum or aluminum alloy substrate is plated using an electroless or electrolytic metal plating solution.

42 Claims, No Drawings

AQUEOUS ACIDIC IMMERSION PLATING SOLUTIONS AND METHODS FOR PLATING ON ALUMINUM AND ALUMINUM ALLOYS

FIELD OF THE INVENTION

This invention relates to aqueous acidic immersion plating solutions and to a process for depositing a zinc alloy protective coating on aluminum or aluminum alloy substrates. The invention also relates to metal plated aluminum or aluminum alloy substrates.

BACKGROUND OF THE INVENTION

One of the fastest growing worldwide markets in the metal finishing/electroplating industry is the processing and plating of aluminum and its alloys. Aluminum's unique physical and mechanical characteristics make it particularly attractive for industries such as automotive, electronics, telecommunications and avionics, along with a plethora of decorative applications. Among aluminum's most endearing properties include it's low overall density (2.7 g/cc), high mechanical strength achieved through alloying and heat treating, and its relatively high corrosion resistance. Additional properties of aluminum include; high thermal and electrical conductance, its magnetic neutrality, high scrap value, and its amphoteric chemical nature. Aluminum articles for many applications are made from a variety of aluminum alloys with alloying elements including: silicon, magnesium, copper, etc. These alloying mixes are formed in order to achieve enhanced properties such as high-strength or ductility.

The plating of aluminum and its alloys requires specific surface preparations for successful electrolytic and electroless deposition. The most common practice used in order to achieve successful electrodeposition is applying an immersion zinc coating (better known as zincate) to the substrate just prior to plating. This procedure has long been considered the most economical and practical method of pre-treating aluminum. The major benefits of applying a zincate layer for pretreatment are the relative low cost of equipment and chemistry, wider operating windows for processing, and ease of applying a controlled deposit.

The presence of other metals in the zincate solutions has an affect on the rate and efficacy of the zinc deposition. Small amounts of alloy components (i.e. Fe, Ni, Cu) improve not only the adhesion of the zincate deposit, but also increase the usability of the zincate on a variety of aluminum alloys. For example, the addition of Fe ions improves the adhesion on magnesium containing alloys. The presence of nickel in the zincate improves the adhesion of nickel plated directly onto the zincate, and similar effects can be found with addition of copper in the zincate and subsequent copper plate. In general, however, the alloying of zincate has shown to provide thinner and more compact deposits which effectively translate into better adhesion of downstream electroless/electrolytic plating. On the other hand, the composition of an alloying zincate becomes more and more complicated with the additional metal ions in the composition. It makes selection of complexing agents more complicated and critical for the overall performance of the zincate. A zinc-iron-nickel composition is more sensitive than zinc-iron compositions for the selection of complexing agents and ratio of metal ions in the composition. This becomes even more critical with the addition of the cooper ions in the alloy zincate. Due to its noble position in the galvanic series, the deposition rate of copper in the immersion zincate deposition is much higher than the other elements in the zincate. Therefore, control of the deposition rate of copper becomes important. It is possible to control the deposition rate of copper by the selection of the right complexing agent(s) for copper ions and adequate ratio with the other metal ions. There are few strong complexing agents for copper ions which offer good stability and performance of the alloying zincate, and cyanide appears to be the best candidate. Cyanide is a complexer of choice for the copper containing zincate compositions and it has been the industry standard for that application for many years. A negative aspect for the use of cyanide is the extremely toxic nature of cyanide, and therefore, like other metal finishing products, the search for a cyanide replacement in the alloying zincate has been a topic of interest for many years.

In recent years there are some non-cyanide alloy zincate compositions that have been developed but these compositions still contain hard complexing agents such as EDTA, NTA, ethylene diamine, etc. to keep the multi-ion system in the stable form which makes waste treatment of spent zincate solutions as well as its rinses more difficult. Zincate treatments also generally perform better under multiple treatment modes. Aluminum pretreatment with a single dip in the zincate doesn't produce as good results as the process with double or triple dips in the zincate prior to the subsequent plating step. Such multiple zincate process requires more processing steps and time, and means a more complicated and less productive and economical process. Therefore, like other metal finishing products, search for replacement of conventional alkaline cyanide or non-cyanide alloying zincate for the plating on aluminum has been a topic of interest in recent years.

SUMMARY OF THE INVENTION

The present invention provides a non-cyanide aqueous acidic immersion plating solution comprising zinc ions, nickel ions and/or cobalt ions, fluoride ions, and optionally, at least one inhibitor containing one or more nitrogen atoms, sulfur atoms, or both nitrogen and sulfur atoms. The present invention also relates to methods for depositing zinc alloy protective coatings on aluminum and aluminum based alloys comprising immersing the aluminum or aluminum based alloy in the acidic immersion plating solutions of the invention to deposit a zinc alloy protective coating, optionally followed by plating the zinc alloy coated aluminum or aluminum alloy substrate using an electroless or electrolytic metal plating solution.

DETAILED DESCRIPTION OF THE INVENTION

The present invention, in one embodiment, relates to aqueous acidic immersion plating solutions which are free of cyanide ions, and more particularly to non-cyanide aqueous acidic immersion plating solutions which are useful for depositing a zinc alloy protective coating on aluminum and various aluminum based alloy substrates. Thus, in one embodiment, the non-cyanide aqueous acidic immersion plating solutions of the invention have a pH of from about 3.5 to about 6.5 and comprise zinc ions, nickel and/or cobalt ions, and fluoride ions provided that the solution is free of cyanide ions. In another embodiment, the aqueous acidic immersion plating solution of the present invention may contain other metal ions such as copper ions, iron ions, manganese ions, and zirconium ions, and/or one or more metal complexing agents. In another embodiment, the solutions also contain at least one inhibitor containing one or more nitrogen atoms, sulfur atoms, or both nitrogen and sulfur atoms.

The aqueous acidic immersion plating solutions of the present invention may be prepared by dissolving water soluble salts of the desired metals in water. Examples of the source of the zinc ions in the immersion plating solutions include zinc fluoride, zinc nitrate, zinc chloride, zinc sulfate, zinc acetate, etc.

Nickel ions can be introduced into the acidic immersion plating solutions by dissolving nickel salts such as nickel acetate, nickel nitrate, nickel sulfate, etc. Cobalt ions may be introduced as cobalt acetate, cobalt nitrate, cobalt sulfate, etc. Salts of iron which are useful in introducing the optional iron ions include ferrous chloride, ferric chloride, ferrous sulfate, ferric sulfate, ferrous nitrate, ferric nitrate, etc. The copper ions may be introduced by dissolving salts such as cuprous chloride, cuprous nitrate, cupric nitrate, cupric chloride, cuprous sulfate, cupric sulfate, etc. in water. Other metal ions may be introduced by dissolving salts such as manganese (II) chloride, manganese (II) sulfate, zirconium chloride, magnesium chloride, magnesium sulfate, etc.

In one embodiment, the immersion plating solutions contain nickel ions but no cobalt ions. In another embodiment the immersion plating solutions contain nickel ions and cobalt ions. In yet another embodiment the immersion plating solutions contain cobalt but no nickel ions. Because of economics, the solutions contain nickel ions or a mixture of nickel with a small amount of cobalt. In one embodiment the concentration of the nickel ions or the cobalt ions, or mixtures of cobalt ions and nickel ions is greater than the concentration of zinc ions.

The immersion plating solutions of the present invention also contain fluoride ion. The source of fluoride ion may be any soluble fluoride compound so long as the ions introduced with the fluoride ion are not detrimental to the performance of the solution. Either metal or ammonium fluorides may be used. Typical fluoride materials include hydrofluoric acid, alkali metal or ammonium fluorides such as sodium fluoride, ammonium fluoride, etc., and alkali metal or ammonium hydrogen fluorides such as sodium hydrogen fluoride, ammonium hydrogen fluoride (ammonium bifluoride), etc. Since high water-solubility is desired whenever possible, highly soluble fluorides such as the sodium or ammonium bifluorides are preferred.

The aqueous acidic immersion plating solutions of the present invention have a pH in the range of from about 3.5 to about 6.5. In another embodiment the pH of the solutions may range from about 4.0 to about 6.0, and in yet another embodiment the pH of the solutions is in the range of about 4.5 to about 5.5.

In one embodiment, the aqueous acidic immersion plating solutions of the present invention will comprise from about 1 to about 150 g/l of zinc ions, from about 5 to about 250 g/l of nickel and/or cobalt ions, and from about 0.005 to about 0.05 g/l of fluoride ion.

In another embodiment, the aqueous acidic plating solutions of the present invention may comprise from about 10 to about 30 g/l of zinc ions, from about 20 to about 50 g/l of nickel and/or cobalt ions, and from about 0.5 to about 10 g/l of fluoride ions.

In one embodiment, the concentration of zinc ions is less than the concentration of nickel and/or cobalt ions.

The aqueous acidic immersion plating solutions of the present invention also may contain at least one inhibitor containing one or more nitrogen atoms, one or more sulfur atoms, or both nitrogen and sulfur atoms. In one embodiment, such nitrogen atoms are not present in an aliphatic amine or hydroxylamine. In another embodiment, the immersion plating solutions of the invention also contain one or more metal complexing agents. Such solutions offer improved stability of the complex system and acceptable performance on a variety of aluminum and aluminum alloys. The immersion plating solutions of the present invention are free of cyanide ions, and such solutions offer the additional advantage of environmentally friendly application for the pretreatment of various metal substrates such as aluminum and aluminum based alloys. In another embodiment, the aqueous acidic plating solutions of the invention are free of hard complexing agents including aliphatic amines such as EDTA, NTA, ethylenediamine, etc.

The inhibitors useful in the immersion plating solutions of the present invention may be selected from a wide variety of compositions which contain nitrogen and/or sulfur atoms. Thus, in one embodiment, the inhibitor may be selected from one or more compounds characterized by the formula

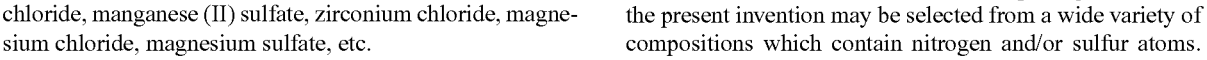

$$R_2N—C(S)Y \quad \text{I}$$

wherein each R is independently hydrogen or an alkyl, alkenyl or aryl group, and Y is $XR^1$, $NR_2$ or $N(H)NR_2$ where X is O or S, and $R^1$ is hydrogen or an alkali metal. Examples of such compounds include thioureas, thiocarbamates, and thiosemicarbazides.

The thiourea compounds which may be utilized in the present invention may be characterized by the formula:

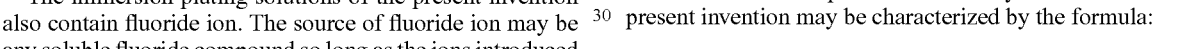

$$[R_2N]_2CS \quad \text{(II)}$$

wherein each R is independently hydrogen or an alkyl, cycloalkyl, alkenyl or aryl group. The alkyl, cycloalkyl, alkenyl and aryl groups may contain up to ten or more carbon atoms and substituents such as hydroxy, amino and/or halogen groups. The alkyl and alkenyl groups may be straight chain or branched. The thioureas used in the present invention comprise either thiourea or the various art recognized derivatives, homologes or analogs thereof. Example of such thioureas include thiourea, 1,3-dimethyl-2-thiourea, 1,3-dibutyl-2-thiourea, 1,3-didecyl-2-thiourea, 1,3-diethyl-2-thiourea, 1,1-diethyl-2-thiourea, 1,3-diheptyl-2-thiourea, 1,1-diphenyl-2-thiourea, 1-ethyl-1-(1-naphthyl)-2-thiourea, 1-ethyl-1-phenyl-2-thiourea, 1 -ethyl-3-phenyl-2-thiourea, 1-phenyl-2-thiourea, 1,3-diphenyl-2-thiourea, 1,1,3,3-tetramethyl-2-thiourea, 1-allyl-2-thiourea, 3-allyl-1,1-diethyl-2-thiourea and 1-methyl-3-hydroxyethyl-2-thiourea. 2,4-dithiobiuret, 2,4,6-trithiobiuret, alkoxy ethers of isothiourea, etc.

The thiocarbamates which can be utilized as inhibitors in the acidic immersion plating solutions of the present invention include thiocarbamates represented by the formula

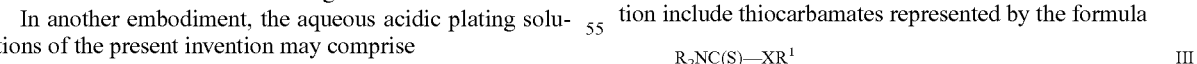

$$R_2NC(S)—XR^1 \quad \text{III}$$

wherein each R is independently hydrogen, or an alkyl, alkenyl, or aryl group, X is O or S, and $R^1$ is hydrogen or an alkali metal. The alkyl and alkenyl groups may contain from about 1 to about 5 carbon atoms. In another embodiment, the alkyl groups can each contain 1 or 2 carbon atoms. In yet another embodiment, both R groups are alkyl groups containing 1 or 2 carbon atoms. Examples of such thiocarbamates include dimethyl dithiocarbamic acid, diethyl dithiocarbamic acid, sodium dimethyidithiocarbamate hydrate, sodium diethyldithiocarbamate trihydrate, etc.

The thiosemicarbazides which can be utilized as inhibitors in the acidic immersion plating solutions of the present invention include thiosemicarbazides represented by the formula $$R_2N—C(S)—N(H)NR_2 \quad IV$$

wherein each R is independently hydrogen or an alkyl, alkenyl or aryl group. In one embodiment, the R groups are alkyl groups containing from 1 to 5 carbon atoms, and in another embodiment, the alkyl groups can each contain 1 or 2 carbon atoms. Examples of such thiosemicarbazides include 4,4-dimethyl-3-thiosemicarbazide and 4,4-diethyl-3-thiosemicarbazide.

The aqueous acidic immersion plating solutions of the present invention also may contain, as inhibitors, one or more nitrogen-containing disulfides such as those represented by the formula $$[R_2NCS_2]_2 \quad V$$

wherein each R is independently hydrogen, or an alkyl, alkenyl or aryl group. The alkyl groups may contain from 1 to about 5 carbon atoms. In another embodiment, the alkyl groups can each contain one or two carbon atoms. In another embodiment, both R groups are alkyl groups containing one or two carbon atoms. Examples of such organic disulfides include bis(dimethylthiocarbamyl)disulfide(thiram) bis(diethylthiocarbamyl)disulfide, etc.

The inhibitors which are useful in the present invention also may be nitrogen-containing heterocyclic compounds which may be substituted or unsubstituted. Examples of substituents include alkyl groups, aryl groups, nitro groups, mercapto groups, etc. The nitrogen-containing heterocyclic compounds may contain one or more nitrogen atoms, and examples of such nitrogen-containing heterocyclic compounds include pyrroles, imidazoles, benzimidazoles, pyrazoles, pyridines, dipyridyls, piperazines, pyrazines, piperidines, triazoles, benzotriazoles, tetrazoles, pyrimidines, etc. The nitrogen-containing heterocyclic compounds may also contain other atoms such as oxygen or sulfur. An example of a heterocyclic compound containing nitrogen and oxygen is morpholine, and examples of nitrogen-containing heterocyclic compounds containing nitrogen and sulfur include thiazoles, thiazolines, and thiazolidines.

In one embodiment, the inhibitor comprises one or more of the above described nitrogen-containing heterocyclic compounds which are substituted with a mercapto group. Specific examples of mercapto substituted nitrogen-containing heterocyclic compounds useful as inhibitors in the immersion plating solutions of the present invention include: 2-mercapto-1-methyl imidazole; 2-mercaptobenzimidazole; 2-mercaptoimidazole; 2-mercapto-5-methyl benzimidazole; 2-mercaptopyridine; 4-mercaptopyridine; 2-mercaptopyrimidine (2-thiouracil); 2-mercapto-5-methyl-1,4-thiadiazole; 3-mercapto-4-methyl-4H-1,2,4-triazole; 2-mercaptothiazoline, 2-mercaptobenzothiazole, 4-hydroxy-2-mercaptopyrimidine; 2-mercaptobenzoxaszole; 5-mercapto-1-methyltetrazole; and 2-mercapto-5-nitrobenzimadole.

The inhibitors which are useful in the immersion plating solutions of the present invention also may include alkali metal thiocyanates such as sodium thiocyanate and potassium thiocyanate. Thio alcohols and thio acids also may be included in the immersion plating solutions of the invention as inhibitors. Examples of these inhibitors include: 3-mercapto ethanol; 6 mercapto-1 -hexanol; 3-mercapto-1,2-propanediol; 1-mercapto-2-propanol; 3-mercapto-1-propanol; mercaptoacetic acid; 4-mercaptobenzoic acid; 2-mercaptopropionic acid; and 3-mercaptopropionic acid.

In one embodiment, the immersion plating solutions of the present invention may contain one or more of the above described inhibitors. In another embodiment, the immersion plating solutions contain two or more of the above described inhibitors. When included in the immersion plating solutions, the amount of inhibitor may vary from about 0.0005 to about 5 g/l or more, and in another embodiment the amount may vary from about 0.005 to about 0.05 g/l.

The immersion plating solutions of the present invention also may contain one or more metal complexing agents. The complexing agents are useful for solubilizing the metal ions in the plating solution. The amount of complexing agent included in the plating solutions of the invention may range from about 5 to about 250 grams per liter or more. In one embodiment, the concentration of the complexing agent(s) is from about 20 to about 100 g/l. Useful complexing agents may be selected from a wide variety of materials including those containing anions such as acetate, citrate, glycollate, lactate, maleate, pyrophosphate, tartrate, gluconate, glucoheptonate, etc. Mixtures of two or more complexing agents may be used in the immersion plating solutions of the present invention. Specific examples of such complexing agents include sodium tartrate, sodium acetate, disodium tartrate, sodium gluconate, potassium gluconate, potassium acid tartrate, sodium potassium tartrate (Rochelle Salt), etc.

The metal complexing agents which may be included in the immersion plating solutions of the present invention also may, in some embodiments, comprise aliphatic amines, aliphatic hydroxylamines or mixtures thereof. In another embodiment, the complexing agents comprises a mixture of one or more aliphatic amine and/or aliphatic hydroxylamine and one or more of the other complexing agents described above. The amount of the amine included in the immersion plating solutions of the present invention may vary from about 1 to about 50 g/l. Examples of the amines which are useful include ethylenediamine, diaminopropane, diaminobutane, N,N,N,N-tetramethyidiaminomethane, diethylenetriamine, 3,3-aminobispropylamine, riethylene tetramine, monoethanolamine, diethanolamine, triethylanolamine, N-methyl hydroxylamine, 3-amino-1-propanol, N-methyl ethanolamine, etc. In another embodiment, the immersion plating solutions of the invention are free of aliphatic amines and aliphatic hydroxylamines.

The aqueous acidic immersion plating solutions of the present invention may be prepared by dissolving the various components mentioned above in water. The components may be mixed with water in any order. Organic acids such as acetic acid, lactic acid, etc. may be included in the plating solutions to adjust the pH of the solution.

The following examples, illustrate the aqueous acidic immersion plating solutions of the present invention. Unless otherwise indicated in the following examples or elsewhere in the written description and/or claims, all parts and percentages are by weight, temperatures are in degrees centigrade and pressure is at or near atmospheric pressure.

TABLE I

| Solution Example* | Examples A–H | | | | | | | |
|---|---|---|---|---|---|---|---|---|
| | A | B | C | D | E | F | G | H |
| Zinc Acetate $2H_2O$ | 30 | 30 | 30 | 30 | 30 | 30 | 30 | 30 |
| Nickel Acetate $4H_2O$ | 30 | 70 | 70 | 70 | 70 | 70 | 70 | 70 |
| Cobalt Acetate $4H_2O$ | — | — | — | — | — | — | — | |
| Ammonium Bifluoride | 1 | 3 | 3 | 3 | 3 | 3 | 3 | 3 |
| 2-Mercaptobenzothiazole | | | 0.01 | | — | — | | |
| 2,2'-dipyridyl | | | | 0.01 | — | — | | |
| 1,3-diethyl-2-thiourea | | | | | 0.01 | — | | |
| 2-benzimidazole | | | | | | 0.01 | | |
| 2-mercapto-1-methylimidazole | | | | | | | 0.01 | |
| 1,10-phenanthroline | | | | | | | | 0.01 |
| pH | 5.5 | 5.5 | 5.5 | 5.5 | 5.5 | 5.5 | 5.5 | 5.5 |

*all parts in g/l, remainder is water

TABLE II

| Solution Example* | Examples I–M | | | | |
|---|---|---|---|---|---|
| | I | J | K | L | M |
| Zinc Acetate $2H_2O$ | 38 | 38 | 45 | 40 | 35 |
| Nickel Acetate $4H_2O$ | 75 | 75 | 100 | 75 | — |
| Cobalt Acetate $4H_2O$ | | | | | 75 |
| Ammonium Bifluoride | 4 | 4 | 5 | 4 | 3 |
| 2-Mercaptobenzothiazole | | 0.005 | 0.005 | 0.005 | 0.005 |
| 2,2'-dipyridyl | | | | | |
| 1,3-diethyl-2-thiourea | | 0.005 | 0.005 | | |
| 2-benzimidazole | | | | | |
| 2-mercapto-1-methylimidazole | | | | 0.005 | 0.005 |
| 1,10-phenanthroline | | | | | |
| pH | 5.0 | 5.0 | 5.0 | 5.0 | 5.0 |

*all parts in g/l, remainder is water

The non-cyanide acidic immersion plating solutions of the present invention which have been described above are useful in depositing zinc alloy protective coatings as a pretreatment for aluminum and various alloys of aluminum. In one embodiment, improved results are obtained when the plating solutions contain one or more of the inhibitors described above. The use of the inhibitors, and the combination of the inhibitors and complexing agents described above in the immersion plating solutions is believed to be responsible, at least in part, for the improved performance of the immersion plating solutions of the present invention. The inhibitors affect the zinc alloy deposition rate and provide a thin even coating on the aluminum and aluminum alloys. Zinc alloy protective coating weights of from about 2-6 mg/ft$^2$ can be obtained with the immersion plating solutions described herein.

In addition to aluminum, the immersion plating solutions of the present invention are useful for depositing a zinc alloy protective coating on various aluminum alloys, including both cast and wrought alloys. Exemplary cast alloys include 356, 380 and 383 alloys. Exemplary wrought alloys include 1100, 2024, 3003, 3105, 5052, 5056, 6061, 6063, and 7075 type aluminum alloys.

In one embodiment, the deposition of the zinc alloy protective coating utilizing the acidic immersion plating solutions of the present invention comprises pre-treatment steps for an optional metal plating of the aluminum or aluminum alloy substrates using an electroless or electrolytic metal plating solution. It should be understood that water rinses generally are employed after each processing step.

The first step in the optional pretreatment process is to clean the aluminum surface of any grease, dirt or oil utilizing, for example, suitable alkaline, acid or solvent, non etch cleaners. Suitable cleaners include nonsilicated mildly alkaline cleaners and silicated mildly alkaline cleaners, both of which are used over a temperature range of about 49° to 66° C. for about 1 to about 5 minutes. After cleaning, the aluminum generally is rinsed in water.

Etching of the cleaned aluminum substrates then is performed using conventional etchants which may be either acidic or alkaline. An acidic etchant generally is used. In one embodiment, the etching solution may comprise 50% nitric acid. In the process utilized in the following Examples, the etching solution used to remove excessive oxide from the aluminum surface is Alklean AC-2 (5% vol) from Atotech USA, and this etching solution comprises phosphoric acid/sulfuric acid/fluoride. The aluminum or aluminum alloy is contacted with Alklean AC-2 for about one to two minutes at about 20-25° C. The etched samples are then rinsed with water.

The etched aluminum surface is then desmutted. Desmutting is a process whereby excess grime is removed from the surface of the aluminum. Desmutting may be performed using a nitric acid solution (e.g., a 50% by volume solution) or a mixture of nitric acid and sulfuric acid. In one embodiment, a typical desmutting solution for aluminum alloys may contain 25% by weight sulfuric acid, 50% by weight nitric acid and 25% by weight ammonium fluoride. Desmutting also can be accomplished with a mixture of nitric and sulfuric acids containing an acidic, fluoride salt product containing ammonium bifluoride. In the Examples which follow, the etched aluminum alloys were desmutted using DeSmutter NF (100 g/l) Atotech USA at a temperature of about 20-25° C. for about one minute and rinsed with water DeSmutter NF comprises a mixture of acid salts and a persulfate-based oxidizing agent.

A zinc alloy protective coating is applied to the etched and desmutted aluminum substrate by immersion of the aluminum substrate in a non-cyanide acidic immersion plating solution of the invention for a brief period of time such as from about 100 to about 150 seconds in order to obtain complete coverage of the aluminum substrate. The temperature of the immersion plating solution is generally maintained between about 20° C. and 25° C. Excess immersion plating solution is removed from the surface of the aluminum substrate, generally by a water rinse in deionized water. In the following Examples, the aluminum is immersed in the indicated immersion plating solution at 20°-25° C. for about 120-150 seconds.

Following the above described acidic immersion plating treatment, the zinc alloy coated aluminum substrates may be plated with any suitable metal utilizing electroless or electrolytic plating processes well known in the art. Suitable metals include nickel, copper, bronze, brass, silver, gold, and platinum. In one embodiment, the zinc alloy coated aluminum substrates are plated in electroless nickel or by electrolytic plating processes such as sulfamate nickel strike or copper pyrophosphate strike solutions.

The following Examples 1-14 illustrate the deposition of a zinc alloy protective coating in accordance with the present invention on various aluminum alloys followed by metal plating. Test plaques of the aluminum alloys of 1 inch by 4 inch with a thickness of 0.09-0.25 inch are used for the plating tests. All the test plaques are cleaned, etched and desmutted as described above before immersion in the non-cyanide acidic immersion plating solutions of the invention. Metal layers are plated up to about 1 mil or somewhat thicker prior to the adhesion test. In Examples 1-13, the zinc alloy coated samples are plated with nickel utilizing Nichem-2500 (Atotech USA) electroless nickel bath for 90 minutes at about 95° C. In Example 14, the zinc alloy coated samples are plated electrolytically in a copper pyrophosphate electroplating solution for 45 minutes at about 25 ASF current density. The zinc alloy coated samples of Example 15 are plated in a sulfamate nickel electrolytic strike bath followed by bright acid copper, bright nickel and decorative chromium electroplating steps. The metal plated samples of Examples 1-15 are then rinsed with water, dried, and tested for adhesion of the nickel or other plated metal to the aluminum substrate. Adhesion of the plated metal is determined using one or more of the following tests. One adhesion test involves using a 90° bend. In this test, after a 90° bending of the plated sample, inside and outside surfaces of the bent area are checked for lift-off (flaking) of the plated metal from the base aluminum substrate. Adhesion of plated metal is rated as: Good (0% lift-off), Fair (less than 10% lift-off on either side of the bent area) and Poor (greater than 20% lift-off). For cast alloys, "Reverse Saw", "Grinding "and "Scribe/Cross-Hatch" methods are used to check the adhesion of the plated metal, and the adhesion is rated using the above criteria. Some plated samples also are tested after baking at 150° C. for two hours, quenched in cold water (20° C.), and the plated surface is then analyzed for blisters using a "no blister/pass" and "blister(s)/fail" criteria.

EXAMPLES 1-10

The immersion plating solutions of Examples A-K and M are used to deposit a zinc alloy coating on wrought aluminum alloys 2024 and 6061. The zinc alloy coated aluminum alloys are then plated in Nichem-2500 (Atotech USA) electroless nickel bath for 90 minutes at about 95° C. The plated samples are rinsed with water, dried, and tested for adhesion using the 90° bend test described above. The results are summarized in the following Table III.

TABLE III

| 90° Bend Adhesion Test Results | | | |
|---|---|---|---|
| Example | Immersion Plating Solution of Example | 2024 Alloy | 6061 Alloy |
| 1 | A | Good/Fair | Fair |
| 2 | B | Good | Fair |
| 3 | C | Good | Good |
| 4 | D | Good | Fair |
| 5 | E | Good | Good |
| 6 | F | Good | Good |
| 7 | G | Good | Good |
| 8 | H | Good | Fair |
| 9 | I | Good | Fair |
| 10 | J | Good | Good |
| 11 | K | Good | Good |
| 12 | M | Good | Good |

EXAMPLE 13

Aluminum alloys including cast alloys 356 and 380, and wrought alloys including 1100, 2024, 3003, 5052, 6061 and 7075 are coated with a zinc alloy using the immersion plating solution of Example L followed by electroless nickel plating. The nickel-plated parts are tested for adhesion in the 90° Bend Test and the grinding and cold water quenching methods. All of the samples are rated as Good.

EXAMPLE 14

Aluminum alloys 2024 and 6061 are coated using the immersion plating solution of Example L by the procedure described above. The zinc alloy coated samples are then plated electrolytically in a copper pyrophosphate bath for 45 minutes at about 25 ASF current density. The copper plated samples are tested for adhesion of the plated copper to the aluminum alloy, and no adhesion failure is noticed in the 90° bend test.

EXAMPLE 15

The procedure of Example 14 is repeated except that the zinc alloy coated parts are plated in a sulfamate nickel electrolytic strike bath followed by bright acid copper, bright nickel and decorative chromium electroplating steps. These electroplated samples are tested for adhesion using the 90° bend test as well as the baking test described above. No adhesion loss or blisters on the plated surface are observed on any of the plated samples.

EXAMPLE 16

The procedure of Example 15 is repeated except the immersion plating solution of Example M is used to deposit the zinc alloy coating. No adhesion loss or blisters on the plated surface are observed in any of the plated samples.

While the invention has been explained in relation to its various embodiments, it is to be understood that other modifications thereof will become apparent to those skilled in the art upon reading the specification. Therefore, it is to be understood that the invention disclosed herein is intended to cover such modifications as fall within the scope of the appended claims.

The invention claimed is:

1. A process for depositing a zinc alloy protective coating on aluminum or aluminum based alloy substrates which comprises (A) immersion plating an aluminum or aluminum based alloy substrate by immersing the substrate in an aqueous acidic immersion plating solution having a pH of from about 4.5 to about 5.5 and comprising zinc ions, nickel and/or cobalt ions, fluoride ions and at least one inhibitor provided the solution is free of cyanide ions for a period of time sufficient to deposit the desired coating, and (B) removing the coated substrate from the immersion plating solution, wherein the at least one inhibitor is a mercapto substituted nitrogen-containing heterocyclic compound and the zinc ions and the nickel and/or cobalt ions are provided with acetate as counter ion.

2. The process of claim 1 wherein the surface of the aluminum or aluminum based alloy is cleaned, etched and desmutted prior to immersion in the immersion plating solution.

3. The process of claim 2 wherein the cleaning is performed with an alkaline, acidic, or solvent cleaner, and the etching is performed with an alkaline or acid etching solution.

4. The process of claim 2 wherein the aluminum or aluminum based alloy is rinsed with water after each of the cleaning, etching, desmutting, and immersion plating steps.

5. The process of claim 1 wherein the plating solution also contains one or more metal complexing agents.

6. The process of claim 5 wherein the metal complexing agent is selected from an acetate, citrate, glycollate, lactate, maleate, pyrophosphate, tartrate, gluconate, or glucoheptonate, and mixtures thereof.

7. The process of claim 1 wherein the plating solution also contains one or more additional metal ions selected from copper ions, iron ions, manganese ions, magnesium ions and zirconium ions.

8. The process of claim 1 wherein the mercapto substituted nitrogen-containing heterocyclic compound is selected from thiazoles, thiazolines, and thiazolidines.

9. The process of claim 1 wherein the plating solution contains from about 1 to about 150 g/l of zinc ions, and from about 5 to about 250 g/l of nickel and/or cobalt ions.

10. The process of claim 1 wherein the plating solution contains from about 0.0005 to about 5 g/l of the inhibitor.

11. The process of claim 1 wherein the plating solution is free of aliphatic amines and aliphatic hydroxylamines.

12. The process of claim 1 wherein the solution further comprises from about 0.5 to about 10 g/l of fluoride ions.

13. A process for depositing a zinc alloy protective coating on aluminum or aluminum based alloy substrate which comprises (A) immersion plating the substrate by immersing the substrate in an aqueous acidic immersion plating solution having a pH of from about 4.5 to about 5.5 and comprising:

from about 10 to about 30 g/l of zinc ions, from about 20 to about 50 g/l of nickel and/or cobalt ions, from about 0.5 to about 10 g/l of fluoride ions, and from about 0.005 to about 0.05 g/l of at least one inhibitor for a period of time sufficient to deposit the desired coating, and (B) removing the coated substrate from the immersion plating solution wherein the at least one inhibitor is a mercapto substituted nitrogen-containing heterocyclic compound and the zinc ions and the nickel and/or cobalt ions are provided with acetate as counter ion.

14. The process of claim 13 wherein the surface of the substrate is cleaned, etched and desmutted prior to immersion in the immersion plating solution.

15. The process of claim 14 wherein the cleaning is performed with an alkaline, acidic, or solvent cleaner, and the etching is performed with alkaline or acid etching solution.

16. The process of claim 14 wherein the substrate is rinsed with water after each of the cleaning, etching, desmutting, and immersion plating steps.

17. The process of claim 13 wherein the plating solution also contains from about 1 to about 250 g/l of at least one metal complexing agent.

18. The process of claim 17 wherein the metal complexing agent is selected from an acetate, citrate, glycollate, lactate, maleate, pyrophosphate, tartrate, gluconate, or glucoheptonate, and mixtures thereof.

19. The process of claim 13 wherein the mercapto substituted nitrogen-containing heterocyclic compound is selected from thiazoles, thiazolines, and thiazolidines.

20. The process of claim 13 wherein the plating solution is free of aliphatic amines and aliphatic hydroxylamines.

21. The process of claim 13 wherein the plating solution further comprises one or more metal ions selected from copper ions, iron ions, manganese Ions, magnesium ions and zirconium ions.

22. A process for depositing a metal coating on an aluminum or aluminum alloy substrate comprising (A) applying an immersion zinc alloy protective coating on the substrate by immersion plating the substrate in an aqueous acidic immersion plating solution having a pH of from about 4.5 to about 5.5 and comprising zinc ions, nickel and/or cobalt ions, fluoride ions and at least one inhibitor provided the solution is free of cyanide ions for a period of time sufficient to deposit the desired coating, and (B) plating the zinc alloy coated substrate using an electroless or electrolytic metal plating solution, wherein the at least one inhibitor is a mercapto substituted nitrogen-containing heterocyclic compound and the zinc ions and the nickel and/or cobalt ions are provided with acetate as counter ion.

23. The process of claim 22 wherein the surface of the substrate is subjected to cleaning, acid etching and desmutting, prior to immersion in the immersion plating solution.

24. The process of claim 23 wherein the cleaning is performed with an alkaline, acidic, or solvent cleaner, and the etching is performed with alkaline or acid etching solution.

25. The process of claim 23 wherein the aluminum or aluminum based alloy is rinsed with water after each of the cleaning, etching, desmutting, and immersion plating steps.

26. The process of claim 22 wherein the plating solution contains from about 1 to about 150 g/l of zinc ions, and from about 5 to about 250 g/l of nickel and/or cobalt ions.

27. The process of claim 22 wherein the plating solution contains from about 0.0005 to about 5 g/l of the inhibitor.

28. The process of claim 22 wherein the plating solution also contains from about 1 to about 250 g/l of at least one metal complexing agent.

29. The process of claim 28 wherein the metal complexing agent is selected from an acetate, citrate, glycollate, lactate, maleate, pyrophosphate, tartrate, gluconate, or glucoheptonate, and mixtures thereof.

30. The process of claim 22 wherein the mercapto substituted nitrogen-containing heterocyclic compound is selected from thiazoles, thiazolines, and thiazolidines.

31. The process of claim 22 wherein the plating solution is free of aliphatic amines and aliphatic hydroxylamines.

32. The process of claim 22 wherein the plating solution further comprises one or more metal ions selected from copper ions, iron ions, manganese Ions, magnesium ions and zirconium ions.

33. The process of claim 22 wherein the solution further comprises from about 0.5 to about 10 g/l of fluoride ions.

34. A process for depositing a zinc alloy protective coating on aluminum or aluminum based alloy substrate which comprises (A) immersion plating the substrate by immersing the substrate in an aqueous acidic immersion plating solution having a pH of from about 4.5 to about 5.5 and comprising:

from about 1 to about 150 g/l of zinc ions, from about 5 to about 250 g/l of nickel and/or cobalt ions, from about 0.005 to about 100 g/l of fluoride ions provided the solution is free of cyanide ions, and from about 0.005 to about 100 g/l of at least one inhibitor for a period of time sufficient to deposit the desired coating, and (B) removing the coated substrate from the immersion plating solution, wherein the at least one inhibitor is a mercapto substituted nitrogen-containing heterocyclic compound and the zinc ions and the nickel and/or cobalt ions are provided with acetate as counter ion.

35. The process of claim 34 wherein the plating solution also contains at least one metal complexing agent.

36. The process of claim 35 wherein the metal complexing agent is selected from an acetate, citrate, glycollate, lactate, maleate, pyrophosphate, tartrate, gluconate, or glucoheptonate, and mixtures thereof.

37. The process of claim 34 wherein the mercapto substituted nitrogen-containing heterocyclic compound is selected from thiazoles. thiazolines, and thiazolidines.

38. The process of claim 34 wherein the plating solution also contains one or more metal ions selected from copper ions, iron ions, manganese Ions, magnesium ions and zirconium ions.

39. The process of claim 34 wherein the plating solution is free of aliphatic amines and aliphatic hydroxylamines.

40. The process of claim 34 wherein the surface of the aluminum or aluminum based alloy is cleaned, etched and desmutted prior to immersion in the immersion plating solution.

41. The process of claim 40 wherein the cleaning is performed with an alkaline, acidic, or solvent cleaner, and the etching is performed with an alkaline or acid etching solution.

42. The process of claim 40 wherein the aluminum or aluminum based alloy is rinsed with water after each of the cleaning, etching, desmutting, and immersion plating steps.

* * * * *